US010854399B2

(12) United States Patent
Sera et al.

(10) Patent No.: US 10,854,399 B2
(45) Date of Patent: Dec. 1, 2020

(54) SWITCH CASE AND SWITCH

(71) Applicant: PANASONIC INTELLECTUAL PROPERTY MANAGEMENT CO., LTD., Osaka (JP)

(72) Inventors: Naoki Sera, Okayama (JP); Masatsugu Takeuchi, Okayama (JP); Daisuke Nakata, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/508,215

(22) Filed: Jul. 10, 2019

(65) Prior Publication Data

US 2019/0333723 A1 Oct. 31, 2019

Related U.S. Application Data

(63) Continuation of application No. 16/055,925, filed on Aug. 6, 2018, now Pat. No. 10,395,859, which is a (Continued)

(30) Foreign Application Priority Data

Feb. 27, 2015 (JP) ..... 2015-038458

(51) Int. Cl.
*H01H 13/06* (2006.01)
*H01H 13/10* (2006.01)
(Continued)

(52) U.S. Cl.
CPC ..... *H01H 13/06* (2013.01); *H01H 11/06* (2013.01); *H01H 13/10* (2013.01); *H01H 13/14* (2013.01);
(Continued)

(58) Field of Classification Search
CPC ..... H01H 13/06; H01H 13/88; H01H 13/86; H01H 11/06; H01H 13/14; H01H 13/10; H01H 2203/038; H01H 2203/028
See application file for complete search history.

(56) References Cited

U.S. PATENT DOCUMENTS 10,074,495 B2 * 9/2018 Sera ..... H01H 13/06
10,395,859 B2 * 8/2019 Sera ..... H01H 13/06
(Continued)

FOREIGN PATENT DOCUMENTS

JP 2011-060627 A 3/2011

OTHER PUBLICATIONS

International Search Report of PCT Application No. PCT/JP2016/000916 dated May 17, 2016.
(Continued)

*Primary Examiner* — Edwin A. Leon
*Assistant Examiner* — Lheiren Mae A Caroc
(74) *Attorney, Agent, or Firm* — McDermott Will & Emery LLP

(57) ABSTRACT

A switch case includes a first metal plate, a dome shape metal plate, and a second metal plate. The first metal plate includes a first ring in which a plurality of first recesses are arranged along the first ring shape, and a second ring in which a plurality of second recesses are arranged along the second ring shape. The second metal plate includes a third ring in which a plurality of third recesses are arranged along the third ring shape, and a fourth ring in which a plurality of fourth recesses are arranged along the fourth ring shape. A direction along a line passing through a center of the first ring and a center of the second ring is different from a direction along a line passing through a center of the third ring and a center of the fourth ring.

23 Claims, 10 Drawing Sheets

Related U.S. Application Data continuation of application No. 15/548,228, filed as application No. PCT/JP2016/000916 on Feb. 22, 2016, now Pat. No. 10,074,495.

(51) Int. Cl.

| | |
|---|---|
| ***H01H 11/06*** | (2006.01) |
| ***H01H 13/86*** | (2006.01) |
| ***H01H 13/88*** | (2006.01) |
| ***H01H 13/14*** | (2006.01) |

(52) U.S. Cl.

CPC ..... *H01H 13/86* (2013.01); *H01H 13/88* (2013.01); *H01H 2203/028* (2013.01); *H01H 2203/038* (2013.01); *H01H 2229/02* (2013.01); *H01H 2229/048* (2013.01)

(56) References Cited

U.S. PATENT DOCUMENTS

| | | | | |
|---|---|---|---|---|
| 2012/0145526 | A1 | 6/2012 | Masuda | |
| 2013/0062170 | A1* | 3/2013 | Takeuchi ..... | H01H 13/06 200/275 |
| 2014/0311882 | A1 | 10/2014 | Terashita et al. | |
| 2018/0019077 | A1 | 1/2018 | Sera et al. | |

OTHER PUBLICATIONS

Notice of Allowance issued in U.S. Appl. No. 15/548,228 dated May 10, 2018.
Non-Final Office Action issued in U.S. Appl. No. 15/548,228 dated Feb. 1, 2018.
Notice of Allowance issued in U.S. Appl. No. 16/055,925 dated Apr. 10, 2019.
Final Office Action issued in U.S. Appl. No. 16/055,925 dated Jan. 28, 2019.
Non-Final Office Action issued in U.S. Appl. No. 16/055,925 dated Sep. 5, 2018.

* cited by examiner

SWITCH CASE AND SWITCH

CROSS-REFERENCE OF RELATED APPLICATIONS

This application is a Continuation application of U.S. patent application Ser. No. 16/055,925, now U.S. Pat. No. 10,395,859, filed on Aug. 6, 2018, which is a Continuation application of U.S. patent application Ser. No. 15/548,228, filed on Aug. 2, 2017, now U.S. Pat. No. 10,074,495, which is the U.S. National Phase under 35 U.S.C. § 371 of International Patent Application No. PCT/JP2016/000916, filed on Feb. 22, 2016, which in turn claims the benefit of Japanese Application No. 2015-038458, filed on Feb. 27, 2015, the entire disclosures of which Applications are incorporated by reference herein.

TECHNICAL FIELD

The present disclosure relates to a switch case and a switch used for an operation unit of various electronic devices.

BACKGROUND

In recent years, various electronic devices have become smaller, lighter, and thinner. Along with these trend, a switch used for an operation unit of an electronic device has also been strongly demanded to become smaller and thinner.

For example, as shown in Unexamined Japanese Patent Publication No. 2011-60627, in the conventional switch, a switch case is formed by molding (insert molding) a case made of insulating synthetic resin in such a manner as to embed a metal member. The central fixed contact of the switch is constituted by a part of the metal member exposed from the inner bottom surface of the opening of the case. In addition, a portion different from the central fixed contact of the metal member protrudes outward from the side surface of the case. This portion constitutes a terminal.

SUMMARY

The present disclosure provides a switch case that suppresses infiltration of water and flux into the switch case while being a thin type, and a switch that uses the switch case.

The switch case of the present disclosure includes a metal plate having a first surface and a second surface that is at a side opposite to the first surface, and a resin case embedding a part of the metal plate. The resin case includes a housing portion having an opening disposed on a surface of the resin case. The metal plate includes a terminal portion, a contact portion, and an intermediate portion positioned between the terminal portion and the contact portion. The terminal portion is exposed from the surface of the resin case. The intermediate portion is embedded in the resin case, and the intermediate portion is provided with first and second through-holes each penetrating the first surface and the second surface. A hole diameter of the first through-hole at the second surface is larger than a hole diameter of the first through-hole at the first surface.

According to the switch case of the present disclosure, the resin case comes into close contact with the metal plate more firmly. Therefore, the infiltration of water or flux into the housing portion from a gap between the resin case and the terminal portion can be suppressed.

DESCRIPTION OF EMBODIMENT

Prior to the description of the exemplary embodiment of the present disclosure, problems of the conventional switch case will be described.

In the conventional switch, when a small switch case is used, water and flux tend to infiltrate into the switch case through a slight gap between the resin member and the terminal.

In the following, an exemplary embodiment of the present disclosure will be described with reference to the accompanying drawings.

Figure 1:
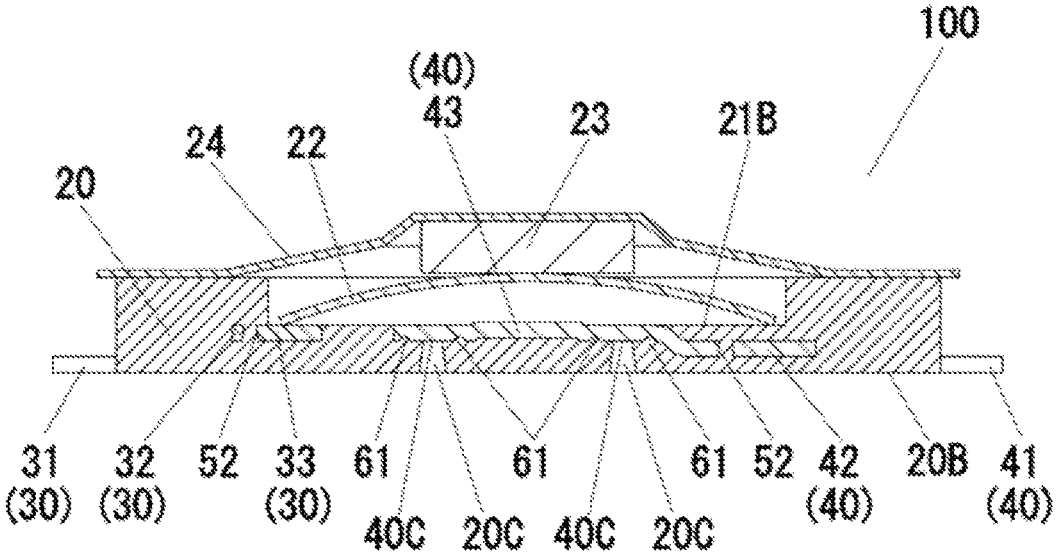
FIG. 1 is a cross-sectional view illustrating a switch in an exemplary embodiment of the present disclosure.
Figure 2:
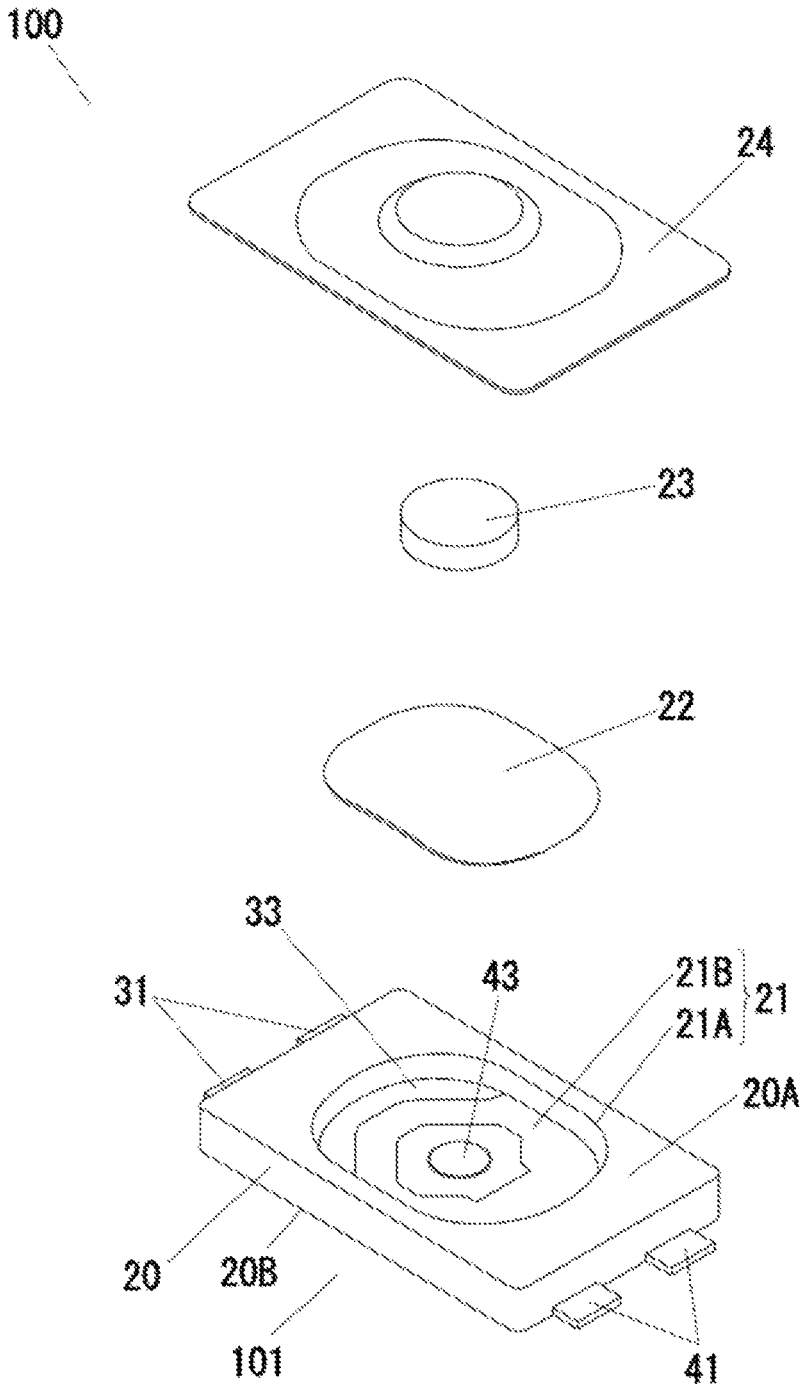
FIG. 2 is an exploded perspective view illustrating the switch in the exemplary embodiment of the present disclosure.

FIG. 1 is a cross-sectional view of switch 100 in the exemplary embodiment of the present disclosure. FIG. 2 is an exploded perspective view of switch 100.

As shown in FIGS. 1 and 2, switch 100 includes switch case 101, movable member 22, and protective sheet 24. Switch case 101 includes resin case 20 and first metal plate 30. In resin case 20, housing portion 21 is formed. Switch case 101 further includes second metal plate 40. Hereinafter, first metal plate 30 is referred to as metal plate 30, and second metal plate 40 is referred to as metal plate 40.

Figure 3:
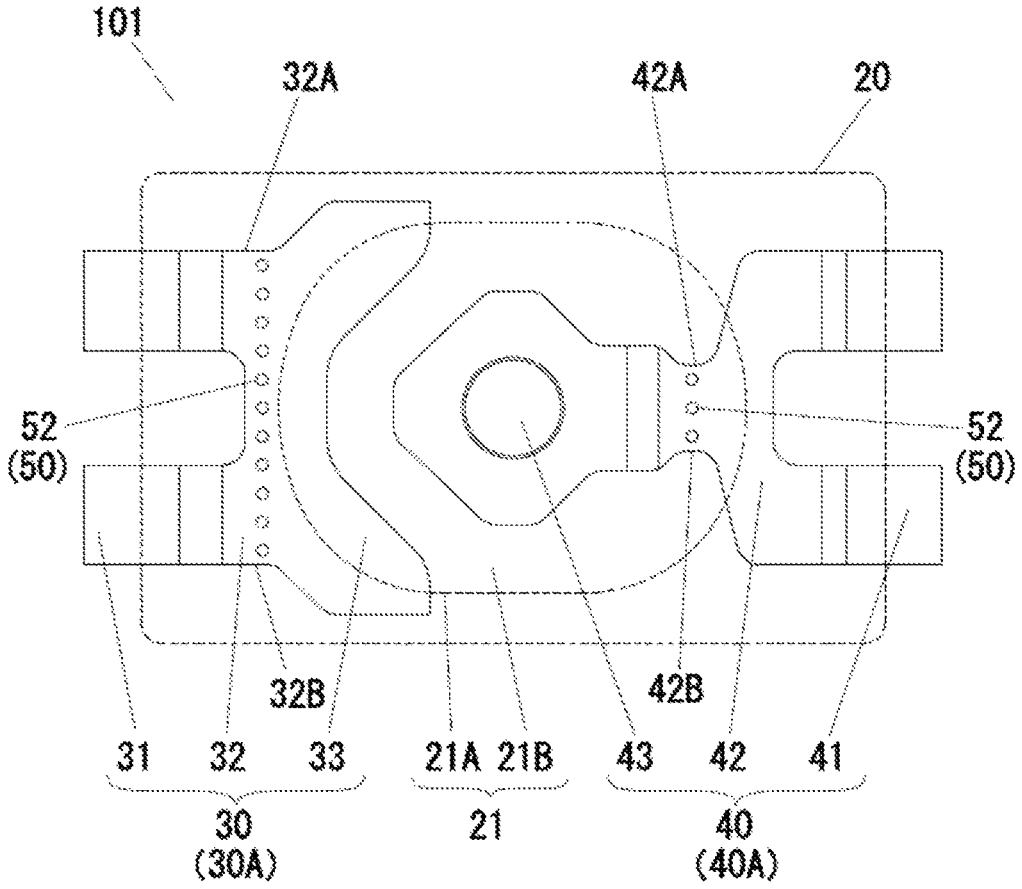
FIG. 3 is a top view illustrating a first metal plate and a second metal plate in the switch shown in FIG. 1.
Figure 4:
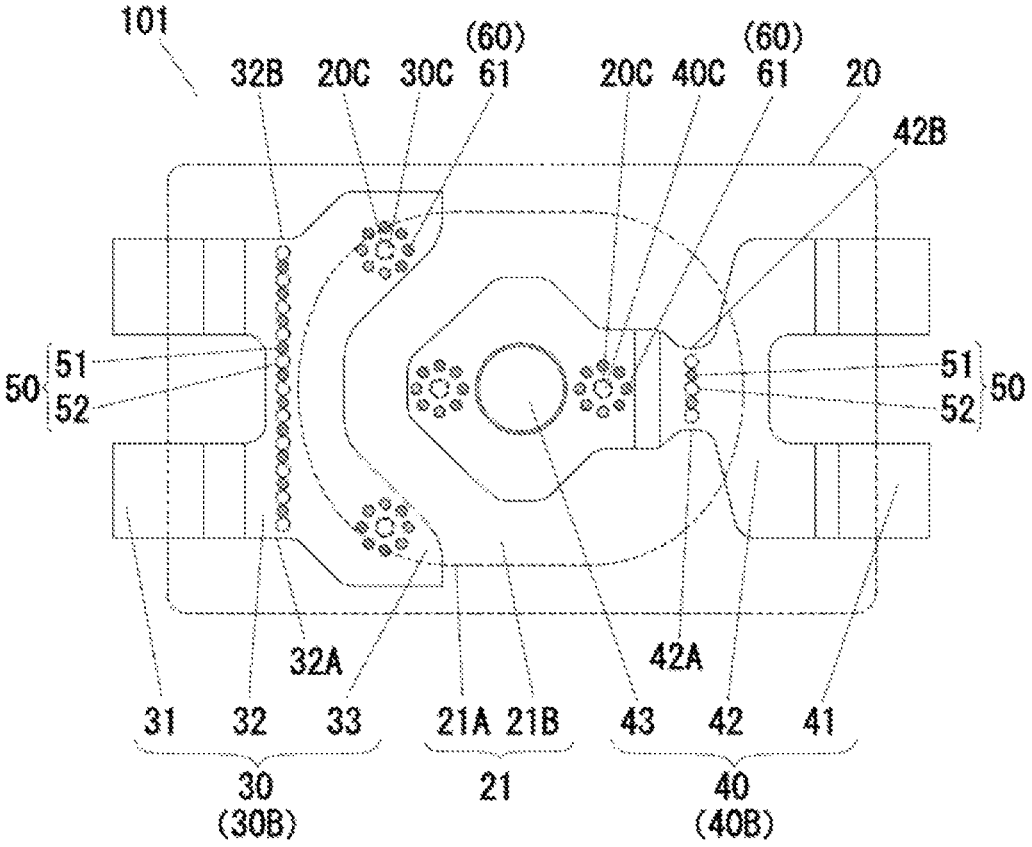
FIG. 4 is a bottom view illustrating the first metal plate and the second metal plate in the switch shown in FIG. 1.

FIG. 3 is a top view of metal plates 30, 40, and FIG. 4 is a bottom view of metal plates 30, 40. It should be noted that in FIGS. 3 and 4, in order to facilitate understanding of the configuration of metal plates 30, 40, resin case 20 is shown in a dashed line and metal plates 30, 40 are shown in solid lines. It should be noted that FIG. 3 is a view of switch case 101 as seen from first surface 30A side. FIG. 4 is a view of switch case 101 as seen from second surface 30B side.

Metal plate 30 has first surface 30A, and second surface 30B that is at a side opposite to first surface 30A. A part of metal plate 30 is embedded in resin case 20. Specifically, resin case 20 is formed on a surface of metal plate 30 by insert molding. Metal plate 30 includes first terminal portion 31, first contact portion 33, and first intermediate portion 32 positioned between first terminal portion 31 and first contact portion 33. Hereinafter, first terminal portion 31 is referred to as terminal portion 31, first intermediate portion 32 is referred to as intermediate portion 32, and first contact portion 33 is referred to as contact portion 33.

Terminal portion 31 is exposed from an outer surface of resin case 20. Intermediate portion 32 is embedded in resin case 20. Contact portion 33 includes a part of first surface 30A exposed to housing portion 21.

In intermediate portion 32, through-hole 52 penetrating from first surface 30A to second surface 30B is formed. In through-hole 52, hole diameter B at second surface 30B is larger than hole diameter A at first surface 30A. Since resin constituting resin case 20 is filled in through-hole 52, resin case 20 comes into close contact with metal plate 30 more firmly. Then, the infiltration of water or flux into housing portion 21 from the gap between resin case 20 and terminal portion 31 is suppressed.

In the following, switch case 101 will be described in detail.

In switch case 101, similarly to metal plate 30, metal plate 40 has first surface 40A, and second surface 40B at the side opposite to the first surface. Similarly to metal plate 30, metal plate 40 includes second terminal portion 41, second contact portion 43, and second intermediate portion 42 positioned between second terminal portion 41 and second contact portion 43. Hereinafter, second terminal portion 41 is referred to as terminal portion 41, second intermediate portion 42 is referred to as intermediate portion 42, and second contact portion 43 is referred to as contact portion 43.

In switch case 101, insulating resin case 20 is formed on metal plates 30, 40 by insert molding.

The shape of resin case 20 is, for example, a rectangular parallelepiped box. Resin case 20 has, for example, upper surface 20A, and bottom surface 20B disposed at a side opposite to upper surface 20A. Resin case 20 is provided with housing portion 21 having opening 21A formed on upper surface 20A. Housing portion 21 has a columnar cavity. In housing portion 21, bottom portion 21B is formed at an opposite end of opening 21A.

Figure 5:
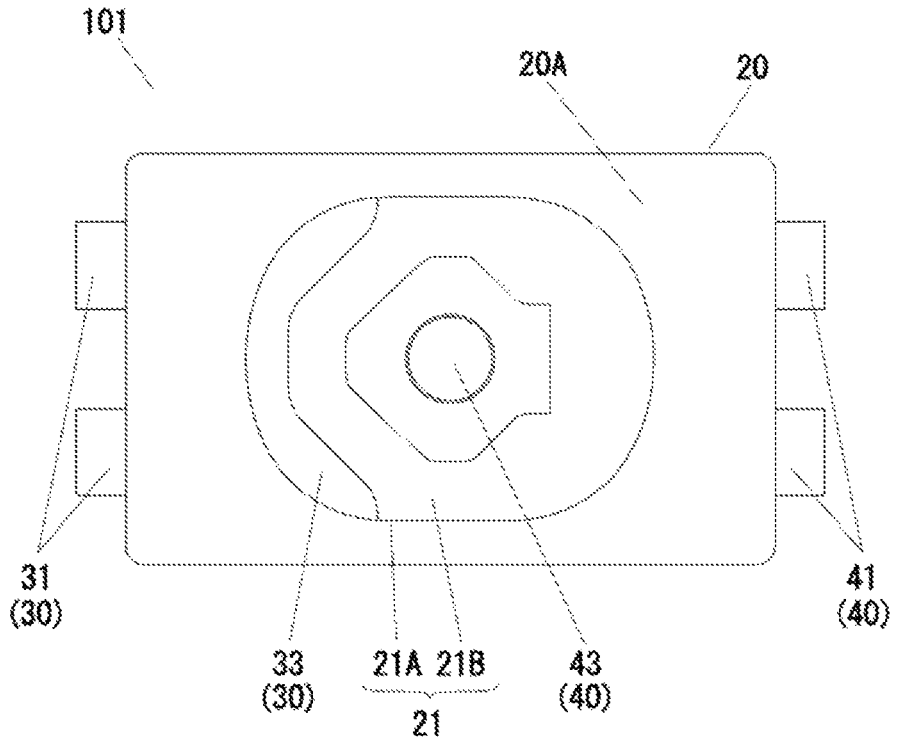
FIG. 5 is a top view illustrating the switch case shown in FIG. 2.

FIG. 5 is a top view of switch case 101. As shown in FIG. 5, in switch case 101, each of contact portions 33, 43 is exposed at bottom portion 21B. As an example, contact portion 33 is arranged in such a manner as to be adjacent to a peripheral edge of bottom portion 21B. Contact portion 43 is disposed in a center of bottom portion 21B. Then, terminal portion 31 and terminal portion 41 respectively protrude outward from an outer side surface of resin case 20. Terminal portion 31 is mechanically and electrically connected to contact portion 33 through intermediate portion 32, and terminal portion 41 is mechanically and electrically connected to contact portion 43 through intermediate portion 42.

Figure 6:
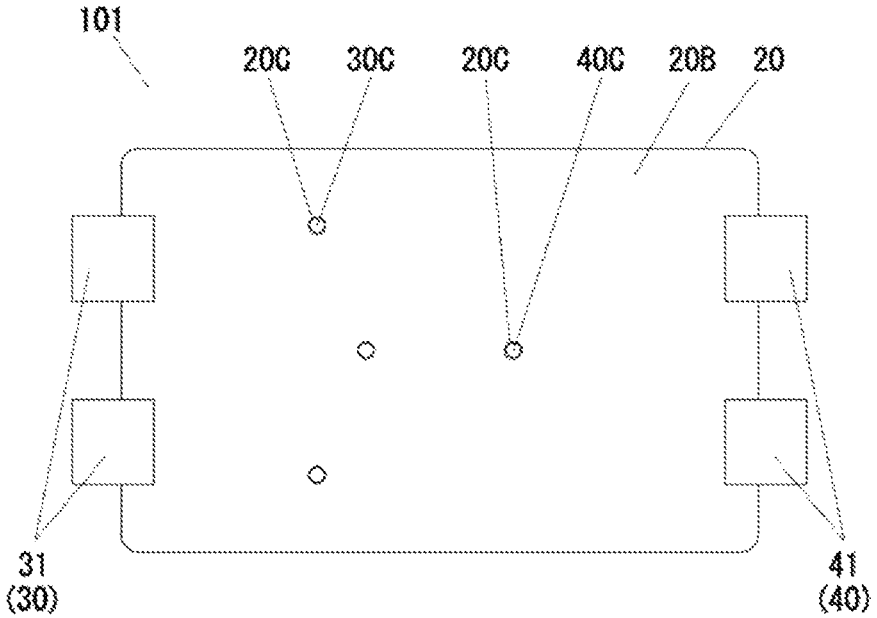
FIG. 6 is a bottom view illustrating the switch case shown in FIG. 2.

FIG. 6 is a bottom view of switch case 101. As shown in FIGS. 1 and 6, at least one pin hole 20C opened on bottom surface 20B may be formed in resin case 20. In a manufacturing process of switch case 101, pin hole 20C is formed as a removed trace by removal of a support pin (not shown) from resin case 20. When resin case 20 and metal plates 30, 40 are formed by insert molding, the support pins fix the positions of metal plates 30, 40. Therefore, as shown in FIGS. 4 and 6, first exposed portion 30C which is a part of metal plate 30 and second exposed portion 40C which is a part of metal plate 40 are exposed from the respective pin holes 20C. Hereinafter, first exposed portion 30C is referred to as exposed portion 30C, and second exposed portion 40C is referred to as exposed portion 40C.

It should be noted that pin hole 20C may be blocked in order to prevent the infiltration of water or flux. The specific method for blocking pin hole 20C includes forming resin case 20 by insert molding then subsequently forming resin case 20 by insert molding again separately. That is, using a method such as twice molding allows a switch case, in which exposed portions 30C, 40C are not formed, to be manufactured.

Next, metal plates 30, 40 will be described in detail.

Each of metal plates 30, 40 is obtained by forming a thin metal plate having thickness T of, for example, from 30 μm to 100 μm, inclusive, so as to have a predetermined shape. In each of metal plates 30, 40, predetermined portions are bent to be formed.

Metal plate 30 is formed in a U shape as an example. Each of a pair of tips in the U shape constitutes terminal portion 31. An end opposite to terminal portion 31 constitutes contact portion 33. Metal plate 40 is formed in a Y shape as an example. A pair of ends branched in the Y shape constitute terminal portions 41. An end opposite to terminal portions 41 constitutes contact portion 43.

Each of intermediate portions 32, 42 is embedded in resin case 20. In metal plates 30, a surface including a portion exposed from bottom portion 21B to housing portion 21 is defined as first surface 30A. In metal plates 40, a surface including a portion exposed from bottom portion 21B to housing portion 21 is defined as first surface 40A. Contact portion 33 has a part of first surface 30A and constitutes a contact for electrically connecting with movable member 22. Contact portion 43 has a part of first surface 40A and constitutes a contact for electrically connecting with movable member 22.

It should be noted that as shown in FIGS. 3 and 4, first structural portion 50 including first recess 51 and through-hole 52 may be formed in each of intermediate portions 32, 42. Hereinafter, first structural portion 50 is referred to as structural portion 50, and first recess 51 is referred to as recess 51. Furthermore, as shown in FIG. 4, second structural portion 60 including a plurality of second recesses 61 may be formed around each of exposed portions 30C, 40C. Hereinafter, second structural portion 60 is referred to as structural portion 60, and second recess 61 is referred to as recess 61.

It should be noted that structural portions 50 formed in each of metal plates 30, 40 have the same function and structure as each other. Structural portions 60 formed in each of metal plates 30, 40 have the same function and structure as each other. Therefore, the same reference mark is given to each of the structural portions. Then, the same reference marks are also given to through-holes 52, recesses 51, 61, and the like formed in each of structural portions 50, 60. Furthermore, the detailed description of the following structural portions 50, 60 may also be described with only any one of metal plate 30 and metal plate 40 so as to avoid unnecessary duplication.

Figure 7:
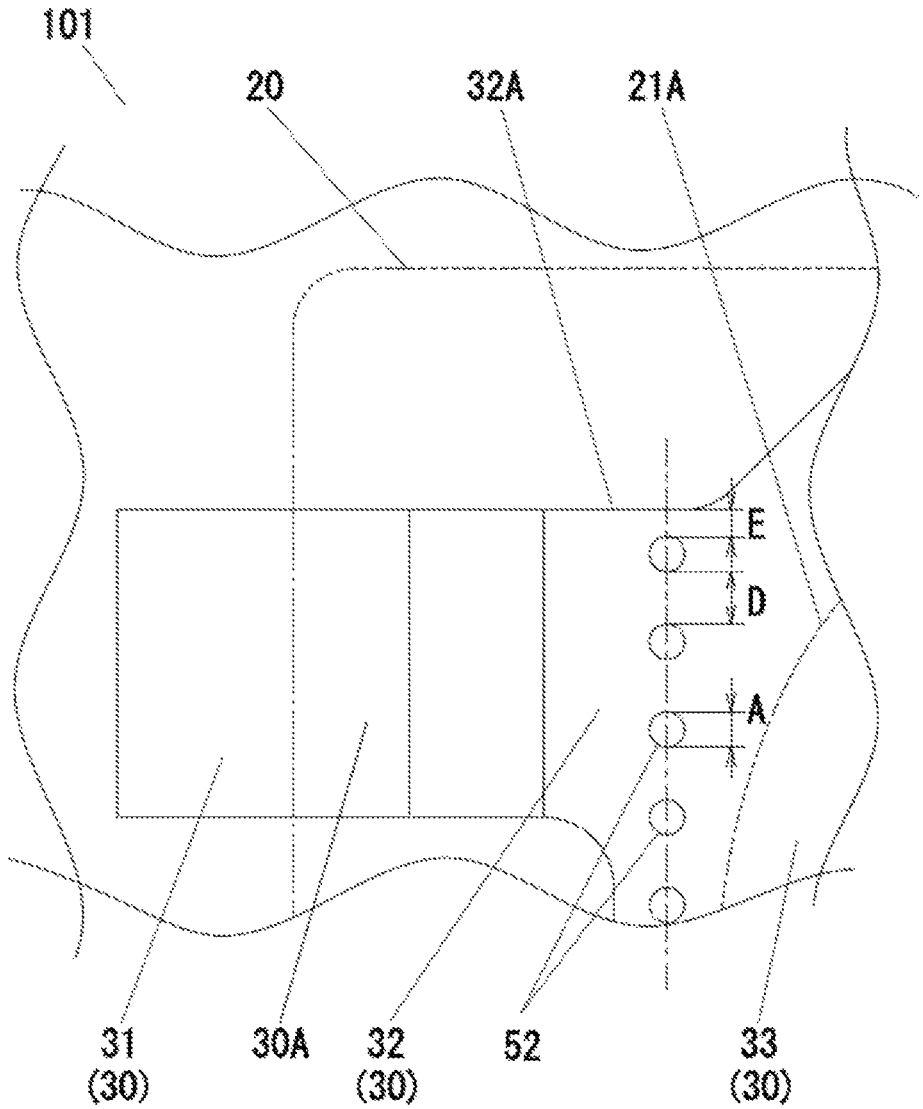
FIG. 7 is a top view partially illustrating the first metal plate shown in FIG. 3.
Figure 8:
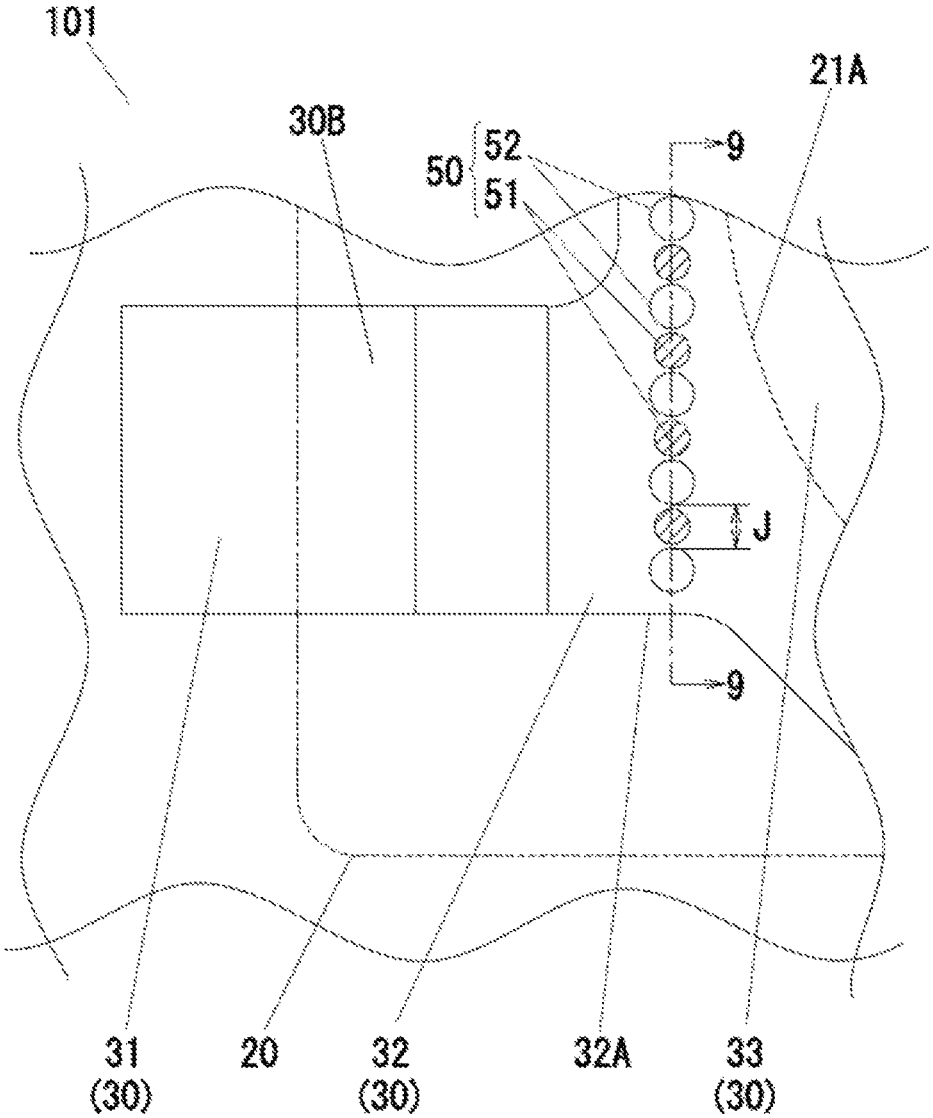
FIG. 8 is a bottom view partially illustrating the first metal plate shown in FIG. 4.
Figure 9:
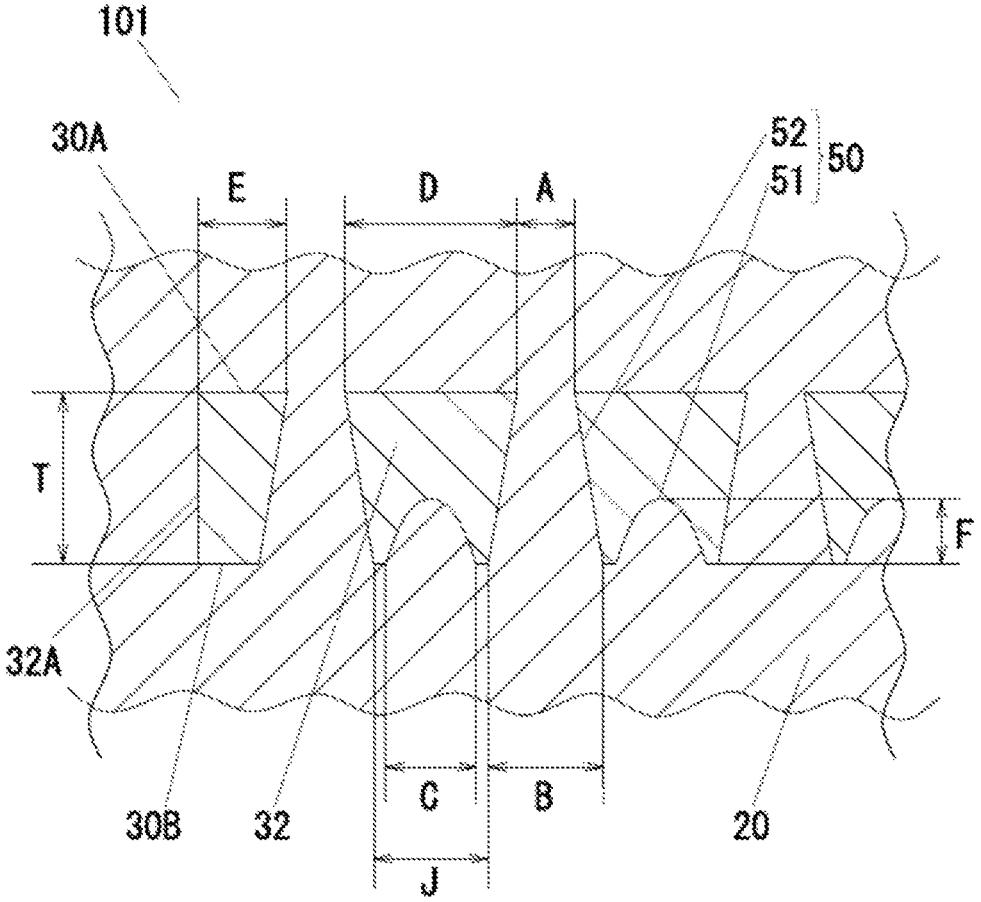
FIG. 9 is a cross-sectional view illustrating the first metal plate taken along line 9-9 shown in FIG. 8.

Next, the configuration of structural portion 50 will be described with reference to FIGS. 3, 4, and 7 to 9. FIG. 7 is a top view partially illustrating metal plate 30, FIG. 8 is a bottom view partially illustrating metal plate 30, and FIG. 9 is a cross-sectional view illustrating metal plate 30 taken along line 9-9 of FIG. 8. It should be noted that FIG. 7 is a view illustrating the main part viewed from first surface 30A, and FIG. 8 is a view illustrating the main part viewed from second surface 30B. In addition, in FIGS. 7 and 8, in order to facilitate understanding of the configuration of the main part, resin case 20 is shown in a dashed line and metal plate 30 is shown in a solid line.

As shown in FIG. 4, structural portion 50 includes recess 51 and a plurality of through-holes 52. Intermediate portion 32 includes first side surface 32A and second side surface 32B provided at both ends. Intermediate portion 42 includes first side surface 42A and second side surface 42B provided at both ends. As shown in FIGS. 3 and 4, in metal plate 30, a plurality of through-holes 52 are formed in such a manner as to line up from first side surface 32A to second side surface 32B. Furthermore, in a part of second surface 30B constituting intermediate portion 32, concavely recessed recess 51 is formed between adjacent through-holes 52. It should be noted that in FIGS. 4 and 8, recess 51 is hatched. In the same manner as metal plate 30, in metal plate 40, structural portions 50 are formed from first side surface 42A toward second side surface 42B.

As a method for forming through-hole 52, for example, a method for forming through-hole 52 by irradiating metal plates 30, 40 with a laser beam can be exemplified. Hereinafter, the forming method is referred to as a laser method. Through-hole 52 having a small hole diameter can be easily formed by the laser method. Furthermore, recess 51 may be formed by the laser method. By using the laser method, recess 51 having a smaller opening diameter than a recess formed by another method can be easily formed.

Then, as shown in FIG. 9, in through-hole 52, hole diameter B at second surface 30B is larger than hole diameter A at first surface 30A. The dimension of hole diameter A is preferably from 20 μm to 60 μm, inclusive. In addition, the dimension of hole diameter B is preferably from 30 μm to 80 μm, inclusive.

Furthermore, as shown in FIGS. 7 and 9, in structural portion 50, shortest distance D between the peripheries of the openings of adjacent through-holes 52 at first surface 30A (distance D) is, for example, from 40 μm to 150 μm, inclusive. Distance D is preferably from 50 μm to 100 μm, inclusive. In addition, on first surface 30A, shortest distance E from first side surface 32A to the periphery of through-hole 52 of intermediate portion 32 (distance E) is, for example, from 40 μm to 150 μm, inclusive. Distance E is preferably from 40 μm to 100 μm, inclusive.

As shown in FIGS. 8 and 9, recess 51 is recessed to be a shape similarly to the shape of a mortar. Hole diameter C of recess 51 is, for example, from 20 μm to 60 μm, inclusive. Depth F of recess 51 is, for example, from 5 μm to 30 μm, inclusive.

It should be noted that in FIGS. 7 and 8, the respective shapes of the openings of through-holes 52 at first surface 30A and at second surface 30B are illustrated as a circle. However, the shape of the opening is not limited to a circle. For example, the shape of the opening may be an ellipse or an oblong. When the shape of the elliptical opening is not circular, the maximum dimension of the opening of through-hole 52 only has to be the dimension of hole diameter A or hole diameter B. In addition, similarly to through-hole 52, the shape of the opening of recess 51 is not limited to a circle either.

It should be noted that a rough surface having fine unevenness may be formed on the inner surface of through-hole 52. An anchor effect or the like occurs between through-hole 52 and resin case 20 due to the above-described rough surface. Therefore, through-hole 52 comes into close contact with resin case 20 more firmly. A laser method can be used for forming through-hole 52 also from the viewpoint of the above-described anchor effect. In addition, the above-described rough surface may also be formed on the inner surface of recess 51 similarly to through-hole 52.

Through-hole 52 is preferably formed by the irradiation of second surface 30B with a laser beam. The above-described irradiation method allows the heat generated when a laser beam is applied to be suppressed from influencing a surface constituting a part of first surface 30 A in contact portion 33. This will be described in detail below.

When through-hole 52 or recess 51 is formed by the laser method, the portion irradiated with a laser beam reaches a high temperature due to heat generation. The heat generated in this case is transferred to a region other than the irradiated part in metal plate 30 by heat conduction. Therefore, the above-described region also reaches a high temperature.

In switch case 101, a laser beam is applied on second surface 30B. In other words, a laser beam is applied to a surface opposite to a surface serving as a contact point in electrical contact with movable member 22 (a part of first surface 30A). When the heat generated by the laser method diffuses by heat conduction, a region affected by the heat of a laser beam at first surface 30A is smaller than a region reaching a high temperature due to heat conduction at second surface 30B which is irradiated with a laser beam, that is, a region affected by the heat of a laser beam at second surface 30B. That is, the influence of heat at first surface 30A is smaller than the influence of heat at second surface 30B. Therefore, irradiating second surface 30B with a laser beam allows a part of first surface 30A in contact portion 33 to be protected against the heat influence of the laser beam. Thus, protecting a part of first surface 30A allows the deformation of contact portion 33 or the elimination of antioxidant formed on a part of a surface of first surface 30A by heat to be suppressed.

Furthermore, setting the surface to be irradiated with a laser beam to second surface 30B allows recess 51 and through-hole 52 to be formed in one manufacturing process. Therefore, the manufacturing process or the manufacturing equipment can be simplified. In addition, structural portion 60 to be described below can also be formed at the same time.

As described above, switch case 101 where structural portion 50 is formed allows resin case 20 to be filled in through-hole 52 as shown in FIG. 9. Thus, improved contact property between intermediate portion 32 and resin case 20 can be achieved. Furthermore, as described above, in the present exemplary embodiment, the surface of recess 51 is formed on a rough surface on which fine unevenness is formed. Thus, recess 51 and resin case 20 come into close contact by the anchor effect or the like. Furthermore, since the inner side surface of through-hole 52 is also formed on a rough surface on which fine unevenness is formed by laser processing, the inner side surface of through-hole 52 and resin case 20 also come into close contact by the anchor effect or the like. Therefore, the contact property between intermediate portion 32 and resin case 20 can be increased to be achieved. Thus, the infiltration of water or flux from a slight gap between terminal portion 31 and resin case 20 into housing portion 21 can be suppressed.

It should be noted that in structural portion 50, recess 51 and through-hole 52 are arranged side by side in a straight line. However, the arrangement of recess 51 and through-hole 52 is not limited. For example, recess 51 and through-hole 52 may be arranged side by side along a curved line.

It should be noted that recess 51 is not always necessary. Structural portion 50 may include only a plurality of through-holes 52, for example. Not forming recess 51 allows a reduction in the cost for forming recess 51, suppression of a reduction in strength of metal plates 30, 40, and suppression of the influence of the laser method.

It should be noted that although structural portion 50 formed in metal plate 30 is mainly described in the above, the same applies to structural portion 50 formed in metal plate 40.

Next, structural portion 60 will be described.

Figure 10:
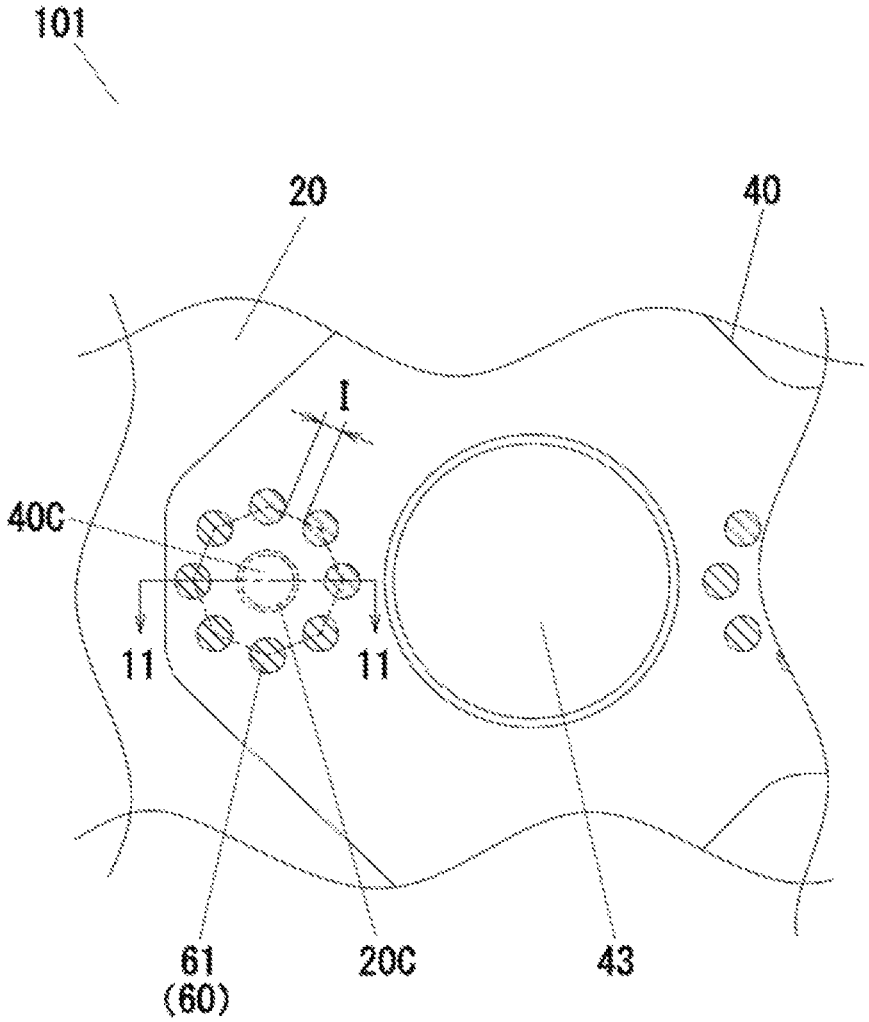
FIG. 10 is a bottom view partially illustrating the second metal plate shown in FIG. 4.
Figure 11:
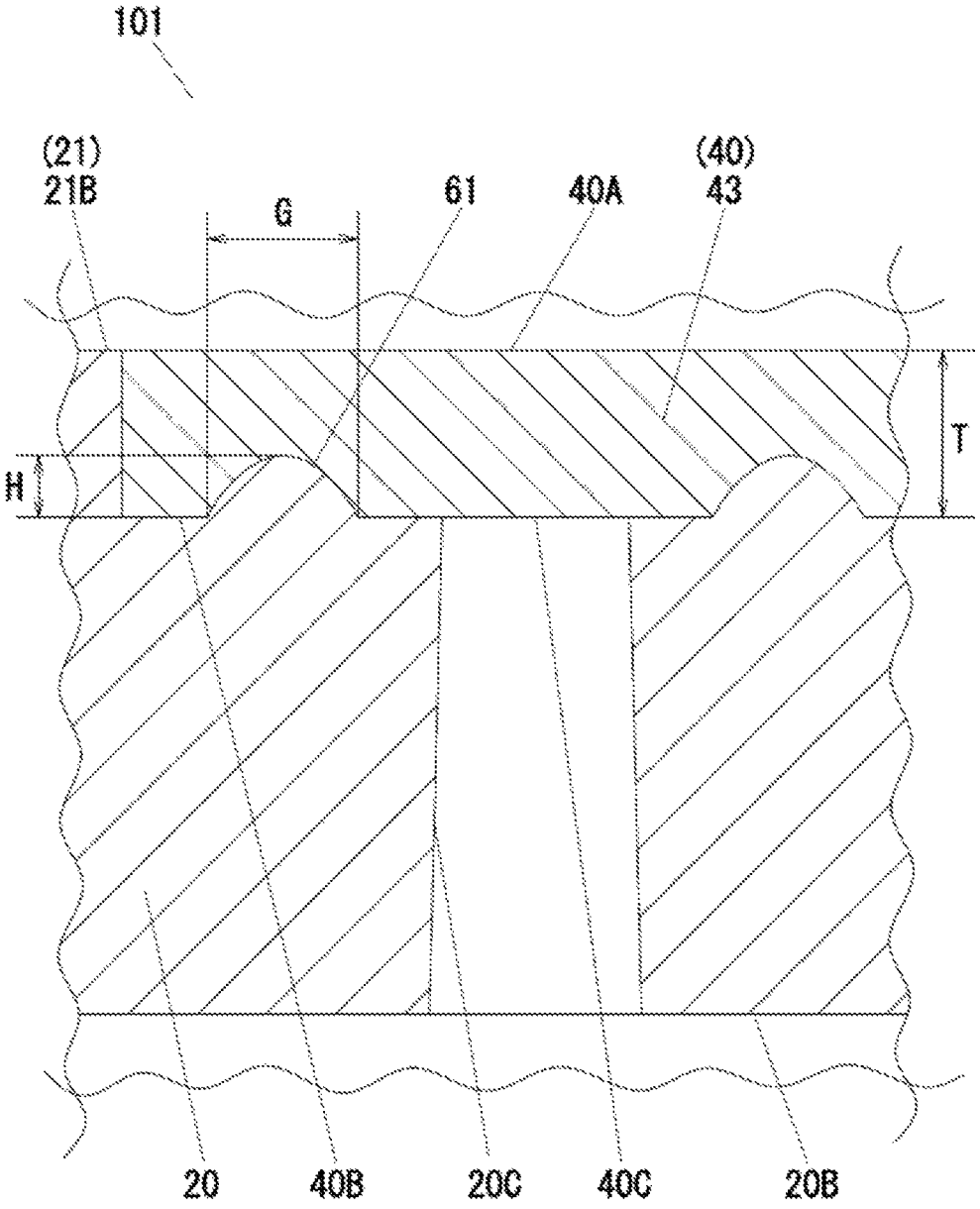
FIG. 11 is a cross-sectional view illustrating the second metal plate taken along line 11-11 of FIG. 10.

FIG. 10 is a top view partially illustrating metal plate 40. FIG. 11 is a cross-sectional view illustrating metal plate 40 taken along line 11-11 of FIG. 10. It should be noted that FIG. 10 is a view of metal plate 40 as viewed from second surface 40B side.

As shown in FIGS. 4 and 10, structural portion 60 includes a plurality of recesses 61. As shown in FIGS. 10 and 11, recess 61 is formed on second surface 40B. Recess 61 is recessed in a mortar shape having, for example, a circular opening. Then, the plurality of recesses 61 are arranged at equal angular intervals in such a manner as to surround each of exposed portions 40C. It should be noted that in FIGS. 4 and 10, recess 61 is hatched.

It should be noted that as shown in FIG. 4, in structural portion 60 formed in metal plate 40, all recesses 61 are formed in contact portion 43. On the other hand, in structural portion 60 formed in metal plate 30, a part of recesses 61 is formed in intermediate portion 32. That is, recess 61 only has to be formed in the portion embedded in resin case 20 on second surfaces 30B, 40B.

The method for forming recess 61 includes the laser method in the same manner as recess 51. Recess 61 having a small opening dimension can be easily formed by the laser method. Then, the laser method allows recesses 51, 61 and through-hole 52 to be simultaneously formed in one manufacturing process. Therefore, the manufacturing process or the manufacturing equipment can be simplified.

In the plurality of recesses 61 shown in FIG. 10, shortest distance I between the peripheries of the openings of adjacent recesses 61 (distance I) is, for example, from 0 μm to 60 μm, inclusive. More preferably, distance I is from 0 μm to 40 μm, inclusive. The case where distance I is 0 μm means that the peripheries of the openings of adjacent recesses 61 are overlapped with each other. As shown in FIGS. 10 and 11, hole diameter G of recess 61 is, for example, from 20 μm to 60 μm, inclusive. Depth H of recess 61 is, for example, from 5 μm to 30 μm, inclusive, and is smaller than the thickness of metal plate 40. Furthermore, in the same manner as recess 51, fine unevenness may be formed on the surface of recess 61. Recess 61 comes into close contact with resin case 20 more firmly due to fine unevenness. The fine unevenness can be formed by the laser method. It should be noted that, in the same manner as recess 51, the shape of the opening of recess 61 is not particularly limited. When the shape of the opening of recess 61 is not circular, the maximum dimension of the opening periphery of recess 61 may be the dimension of hole diameter G.

In addition, the plurality of recesses 61 only have to be arranged in such a manner as to surround exposed portion 40C. Therefore, for example, a plurality of recesses 61 may be arranged in such a manner as to constitute a plurality of concentric circles having different radii each of which is centered around the central part of exposed portion 40C, and the plurality of concentric circles may surround exposed portion 40C.

As described above, in structural portion 60, recess 61 can come into close contact with resin case 20 more firmly due to the anchor effect or the like around exposed portion 40C. Therefore, in switch case 101, the infiltration of water or flux from pin hole 20C into housing portion 21 can be suppressed.

It should be noted that although structural portion 60 formed in metal plate 40 is mainly described in the above, the same applies to structural portion 60 formed in metal plate 30.

In the following, switch 100 will be described in detail.

As shown in FIGS. 1 and 2, switch 100 further includes pressing body 23. As shown in FIG. 1, movable member 22 is formed in an upwardly projecting dome shape. Movable member 22 is made of, for example, a thin metal plate having elasticity. Movable member 22 is held inside housing portion 21 with the outer peripheral edge of movable member 22 abutting on contact portion 33. The central part at the lower surface of movable member 22 faces contact portion 43 with spaced apart. Protective sheet 24 is made of an insulating film. Protective sheet 24 is disposed on upper surface 20A in such a manner as to cover opening 21A. The peripheral portion of protective sheet 24 is fixed to upper surface 20A. That is, housing portion 21 is sealed by closing housing portion 21 with protective sheet 24 hermetically. Protective sheet 24 is welded to resin case 20 by laser irradiation, for example. It should be noted that protective sheet 24 may be bonded to resin case 20 by using an adhesive or the like. Furthermore, the lower surface of protective sheet 24 is fixed to pressing body 23 made of an insulating resin. The lower surface of pressing body 23 is disposed on the center of the upper surface of movable member 22. Protective sheet 24 is also welded to pressing body 23 by laser irradiation. Switch 100 is configured as described above.

The operation of switch 100 will be described.

First, the central part of movable member 22 is pressed via pressing body 23 by pushing pressing body 23 downward via protective sheet 24. Then, movable member 22 is inverted by the press describes above. The lower surface of movable member 22 comes into contact with contact portion 43, and this yields conduction state between terminal portion 31 and terminal portion 41.

Then, when the pressing force is released, movable member 22 is restored to the original dome shape projecting upward by its own restoring force. Then, switch 100 returns to the OFF state in FIG. 1. Thus, movable member 22 functions as a movable contact.

As described above, switch case 101 and switch 100 can suppress water or flux from infiltrating into housing portion 21 by the improvement of the contact property between resin case 20 and metal plate 30 or the contact property between resin case 20 and metal plate 40.

It should be noted that the technical idea of the present disclosure is not limited to switches. For example, the technical idea can be applied to an electronic component such as an encoder where a resin case is formed in a metal plate by insert molding, and the electronic component including a contact portion exposed from inside the housing portion of the resin case, and a terminal portion exposed outside the resin case.

The switch case and the switch according to the present disclosure suppress the infiltration of water or flux into the switch case with improved contact property between the resin case and the metal plate. The switch case of the present disclosure is useful for an electronic component. Then, the electronic component is useful for an electronic apparatus.

What is claimed is:

1. A switch comprising:

a resin case;

a first metal plate at least partially embedded in the resin case and including a contact portion exposed from the resin case;

a dome shape metal plate facing the contact portion; and a second metal plate configured to be electrically connected to the first metal plate via the dome shape metal plate, wherein:

the first metal plate further includes:

a first surface;

a second surface opposite to the first surface;

a first ring, in which a plurality of first recesses are arranged along the first ring shape, located on the second surface; and a second ring, in which a plurality of second recesses are arranged along the second ring shape, located on the second surface, the second metal plate includes:

a third surface;

a third ring, in which a plurality of third recesses are arranged along the third ring shape, located on the third surface; and a fourth ring, in which a plurality of fourth recesses are arranged along the fourth ring shape, located on the third surface, and a direction along a line passing through a center of the first ring and a center of the second ring is different from a direction along a line passing through a center of the third ring and a center of the fourth ring.

2. The switch according to claim 1, wherein the direction along the line passing through the center of the first ring and the center of the second ring is orthogonal to the direction along the line passing through the center of the third ring and the center of the fourth ring.

3. The switch according to claim 1, wherein:

each of the plurality of first recesses and each of the plurality of second recesses recess from the first surface toward the second surface, and a depth of the each of the plurality of first recesses and a depth of the each of the plurality of second recesses are smaller than the thickness of the first metal plate.

4. The switch according to claim 3, wherein:

the second metal plate further includes a fourth surface opposite to the third surface, each of the plurality of third recesses and each of the plurality of fourth recesses recess from the third surface toward the fourth surface, and a depth of the each of the plurality of third recesses and a depth of the each of the plurality of fourth recesses are smaller than the thickness of the second metal plate.

5. A switch comprising:

a resin case; and a metal plate that includes a portion embedded in the resin case;

wherein:

the metal plate includes:

a first surface;

a second surface opposite to the first surface;

a side surface disposed between the first surface and the second surface in the embedded portion of the metal plate; and four or more recesses formed on the second surface in the embedded portion of the metal plate, the four or more recesses being aligned with each other, the resin case contacts the second surface of the metal plate and an inner surface of each of the four or more recesses in the embedded portion of the metal plate, a depth of each of the four or more recesses are smaller than a distance between the first surface and the second surface, and respective minimum distances from the four or more recesses to the side surface are different from one another.

6. The switch according to claim 5, wherein a line passing through the four or more recesses intersects the side surface.

7. The switch according to claim 5, wherein the inner surface of each of the four or more recesses is rougher than the second surface.

8. The switch according to claim 5, wherein the four or more recesses are arranged on a single straight line.

9. The switch according to claim 5, wherein the first surface of the metal plate has a hole provided therein, and when viewed in a direction perpendicular to the first surface of the metal plate, the hole is located between a pair of adjoining recesses out of the four or more recesses.

10. The switch according to claim 9, wherein the hole extends fully through the metal plate.

11. The switch according to claim 5, wherein the first surface of the metal plate has a plurality of holes provided therein, and the plurality of holes and the four or more recesses are located alternately when viewed in a direction perpendicular to the first surface of the metal plate.

12. The switch according to claim 11, wherein the plurality of holes extend fully through the metal plate.

13. The switch according to claim 5, further comprising:

a movable member made of a metal facing the first surface of the metal plate with a gap between the movable member and the first surface of the metal plate, wherein the movable member is configured to contact the first surface of the metal plate such that the switch is turned on upon the contacting of the movable member with first surface of the metal plate.

14. A switch comprising:

a resin case; and a metal plate that includes a portion embedded in the resin case, wherein:

the metal plate includes:

a first surface, a second surface opposite to the first surface, a side surface disposed between the first surface and the second surface in the embedded portion of the metal plate, and four or more recesses formed on the second surface in the embedded portion of the metal plate, aligned with each other, and disposed at respective positions located away from the side surface by respective distances different from one another, the resin case contacts the second surface of the metal plate and an inner surface of each of the four or more recesses in the embedded portion of the metal plate, and the four or more recesses do not extend fully through the metal plate.

15. The switch according to claim 14, wherein an inner surface of each of the four or more recesses is rougher than the second surface of the metal plate.

16. The switch according to claim 14, wherein the four or more recesses are arranged on a single straight line.

17. The switch according to claim 14, wherein the first surface of the metal plate has a hole provided therein, and when viewed in a direction perpendicular to the first surface of the metal plate, the hole is located between a pair of adjoining recesses out of the four or more recesses.

18. The switch according to claim 17, wherein the hole extends fully through the metal plate.

19. The switch according to claim 14, wherein the first surface of the metal plate has a plurality of holes provided therein, and the plurality of holes and the four or more recesses are located alternately when viewed in a direction perpendicular to the first surface of the metal plate.

20. The switch according to claim 19, wherein the plurality of holes extend fully through the metal plate.

21. The switch according to claim 14, further comprising:

a movable member made of a metal facing the first surface of the metal plate with a gap between the movable member and the first surface of the metal plate, wherein the movable member is configured to contact the first surface of the metal plate such that the switch is turned on upon the contacting of the movable member with first surface of the metal plate.

22. A switch comprising:

a resin case;

a first metal plate at least partially embedded in the resin case and including a contact portion exposed from the resin case;

a dome shape metal plate facing the contact portion; and a second metal plate configured to be electrically connected to the first metal plate via the dome shape metal plate, wherein:

the resin case has a first pin hole, a second pin hole, a third pin hole, and a fourth pin hole, each of which extends fully through the resin case, the first metal plate has a first surface and a second surface opposite to the first surface, a plurality of first recesses and a plurality of second recesses are provided in the second surface of the first metal plate, the plurality of first recesses are arranged to surround the first pin hole when viewed in a direction perpendicular to the second surface of the first metal plate, the plurality of second recesses are arranged to surround the second pin hole when viewed in the direction perpendicular to the second surface of the first metal plate, the second metal plate has a third surface, a plurality of third recesses and a plurality of fourth recesses are provided in the third surface of the second metal plate, the plurality of third recesses are arranged to surround the third pin hole when viewed in the direction perpendicular to the third surface of the second metal plate, the plurality of fourth recesses are arranged to surround the fourth pin hole when viewed in the direction perpendicular to the third surface of the second metal plate, and a direction along a line passing through the first pin hole and the second pin hole is different from a direction along a line passing through the third pin hole and the fourth pin hole.

23. The switch according to claim 22, wherein at least one of the first pin hole, the second pin hole, the third pin hole, and the fourth pin hole is blocked.

* * * * *